United States Patent [19]

Brionne

[11] 4,097,862

[45] Jun. 27, 1978

[54] ACOUSTIC WARNING DEVICE, IN PARTICULAR A BELL

[75] Inventor: Yves Brionne, Pau, France

[73] Assignee: Legrand S.A., Limoges, France

[21] Appl. No.: 754,022

[22] Filed: Dec. 23, 1976

[30] Foreign Application Priority Data

Dec. 24, 1976 France ..... 75 39663

[51] Int. Cl.[2] ..... G08B 3/00

[52] U.S. Cl. ..... 340/396; 340/392

[58] Field of Search ..... 340/392, 396, 402

[56] References Cited

U.S. PATENT DOCUMENTS

| | | | |
|---|---|---|---|
| 2,659,074 | 11/1953 | Alexander | 340/392 |
| 2,683,871 | 7/1954 | Meleski | 340/396 |
| 2,799,016 | 7/1957 | Christy | 340/392 |
| 2,946,905 | 7/1960 | Jolly | 340/392 |
| 3,375,803 | 4/1968 | Doggart | 340/392 |

*Primary Examiner*—Harold I. Pitts
*Attorney, Agent, or Firm*—Henry R. Lerner

[57] ABSTRACT

An acoustic warning device of the type comprising a striker member which is also the movable core member of a control solenoid. A radially polarized permanent magnet is disposed at one end of the solenoid, e.g. opposite a gong therefor, and a spring defines with the permanent magnet a rest position of the core/striker member. The end of the core/striker member proximate to the permanent magnet is limited in its outward displacements within the axial extent of the permanent magnet means. The flux through the solenoid is carried mainly by the core member. The alternating polarization of the core/striker member ends is alternately attracted and repelled by the magnetic flux of the permanent magnet which is the equivalent of an imaginary axially polarized magnet in the passage through the solenoid.

26 Claims, 13 Drawing Figures

ACOUSTIC WARNING DEVICE, IN PARTICULAR A BELL

BACKGROUND OF THE INVENTION

The present invention generally concerns acoustic warning devices such as a bell, buzzer or the like, which comprise a resonator such as a bell member, a striker member forming the movable core of a control solenoid and adapted to co-operate with the resonator to produce a sound, and at least one permanent magnet associated with the solenoid and arranged to define, in conjunction with a counteracting spring, the rest position of the striker member.

In previously known constructions of this type, a magnetic iron circuit is usually associated with the control solenoid to close the flux thereof, and the permanent magnet which is also associated with the solenoid is either interposed into the magnetic circuit in parallel to the solenoid, with its pole line then being parallel to the axis of the solenoid, or joined to the magnetic circuit in axial alignment with the solenoid, its pole line then being on the axis of the solenoid.

In both cases, the magnetic circuit closes both the flux of the solenoid when the latter is supplied with voltage, and the flux of the permanent magnet which is associated with such solenoid, and the magnetic circuit therefore sets these two fluxes in algebraic series with each other.

In practice, in one half-wave of the supply voltage for the solenoid, the flux which is instantaneously developed by the solenoid is added to the permanent flux due to the permanent magnet associated with the solenoid, while for the other half-wave of the supply voltage, the solenoid flux is subtracted from that of the magnet.

Thus, for one half-wave of the solenoid supply voltage, the movable core of the solenoid, which forms the striker member associated with the resonator, is displaced in a first direction, so that, depending on its rest position, it either moves to strike the resonator or moves away therefrom, and, for the other half-wave, it is displaced in the opposite direction.

Now, the attraction force developed by the permanent magnet as regards the movable core forming the striker member is at a maximum when the movable core is closest to the permanent magnet.

Consequently, in order to have a substantial amplitude of movement for the movable core of the solenoid, and therefore to provide for striking of the resonator under good conditions, and in order however that the force of attraction developed by the permanent magnet on the movable core is assured of remaining effective irrespective of the position of the movable core, it is in practice necessary for this purpose for the permanent magnet to be over-dimensioned, which is expensive.

In addition, because of the very size of the magnet, the flux losses in air are substantial, to the detriment of the efficiency of the assembly.

Moreover, the attraction force developed by the permanent magnet as regards the movable core of the solenoid usually varies inversely proportionally to the square of the distance of the movable solenoid with respect to the permanent magnet, whereas the counteracting force applied to the movable core by the spring associated therewith varies linearly in proportion to the displacement of the movable core, so that, depending on the assembly used, the spring is compressed or is extended when the movable core is moved away from its rest position.

In every case, the attraction force developed by the permanent magnet increases much more quickly than the counteracting force developed by the spring, and there is rapidly therefore within the assembly an excess of energy which must be dissipated, although only a part of this excess energy can be usefully recovered, at the cost however of complexities as regards assembly and difficulties in adjustment.

SUMMARY OF THE INVENTION

Generally, the present invention concerns an acoustic warning device of the kind mentioned above, in which a particular assembly of permanent magnets makes it possible largely to overcome the disadvantages briefly set out above.

More precisely, the present invention concerns an acoustic warning device such as a bell, buzzer or the like, of the kind comprising a resonator such as a bell member, a striker member forming the movable core of a control solenoid and adapted to co-operate with the resonater, and at least one permanent magnet associated with the solenoid and arranged to define, in conjunction with a counteracting spring, the rest position of the striker member, the acoustic warning device being generally characterised in that its control solenoid has associated therewith at least two permanent magnets arranged in opposition, the permanent magnets being uniformly distributed in a circular manner around the axis of the solenoid, at one of the axial ends thereof, and all having their pole lines substantially perpendicular to said axis, with a like pole directed towards said axis.

These permanent magnets which are for example two or three in number, form axially between them a passage in which the movable core of the solenoid, which forms the striker member, can at least partly engage and, because of the orientation of the pole lines of the permanent magnets, a single imaginary magnet is immaterially reconstituted in said passage, the pole line of the single imaginary magnet being in the axis of the solenoid and corresponding to poles of like polarity.

This arrangement provides various advantages which overall provide for achieving an improved efficiency for the assembly, and a reduction in the production and assembly costs.

Firstly, it is no longer necessary to provide any magnetic circuit around the control solenoid.

Moreover, it is possible for the permanent magnets to be arranged radially closest to the path of movement of the movable core of the solenoid, which forms the striker member, and in consequence to reduce the gap at that position.

Finally, as the movable core which forms the striker member can not only move towards the imaginary magnet which is equivalent to the permanent magnets used, in the usual manner during a first phase, but also, in a second phase, can enter into the imaginary magnet in view of the immaterial nature thereof, the attraction force applied to the movable core by the imaginary magnet in the second phase advantageously varies substantially linearly and therefore varies as the counteracting force developed by the spring associated with the movable core, as the variation in reluctance is then proportional to the travel of the core, except for distortions and losses.

The features and advantages of the invention will be apparent from the following description given by way of example with reference to the accompanying diagrammatic drawings.

The drawings illustrate by way of example the application of the invention to the construction of a bell.

DESCRIPTION OF THE PREFERRED EMBODIMENTS

Figure 1:
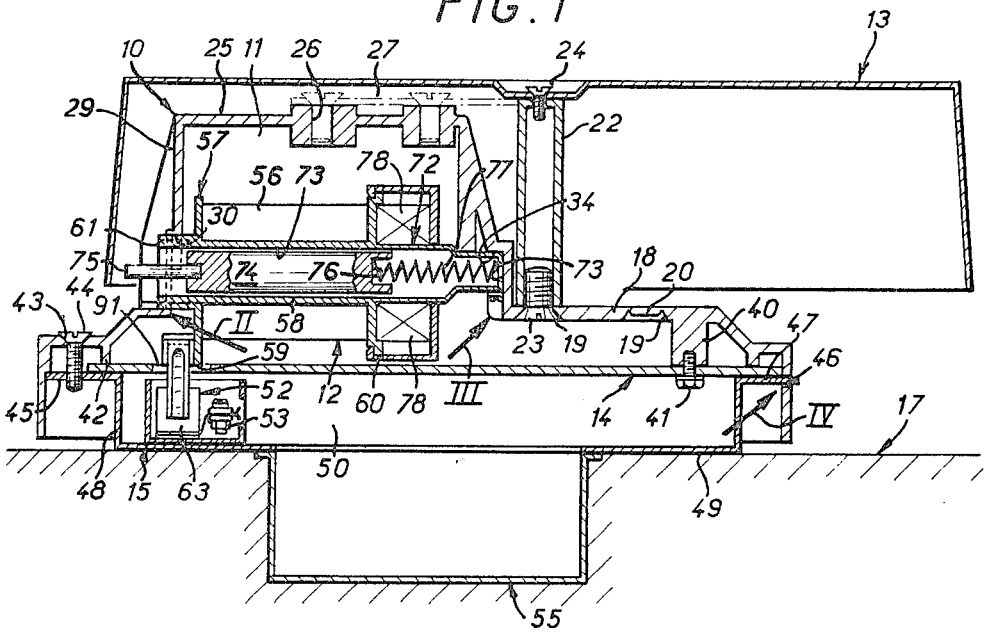
FIG. 1 is a view in axial section of an acoustic warning device according to the invention.

As shown in FIG. 1, a dome generally comprises a bell-shaped casing 10 whose interior 11 is arranged to provide a housing for a control mechanism 12 which is described in greater detail hereinafter and onto which a bell member 13 forming a resonator can be fixed.

In the embodiment illustrated, the interior 11 of the casing 10 is closed at its base by a plate 14, and a mounting plate 15 is associated with the casing 10. The mounting plate 15 is adapted to be fixed to any support, as for example to a wall 17, as illustrated, and the casing 10 can be fixed to the plate 15, in ways which will be described below.

Preferably, and as illustrated, so that bell members 13 of different dimensions can be fitted to the casing 10, which bell members are usually in the general shape of a conventional bell-shaped configuration, such a casing 10 comprises an intermediate plate 18 which is parallel to the closure plate 14 and which has a plurality of passages 19, there being two such passages in the embodiment illustrated, each of which is normally closed by a rupturable diaphragm member 20.

As shown, after the diaphragm member 20 of a passage as at 19 has been removed, the passage 19 can be used for fixing a leg member 22 to the casing 10 for example by means of a screw 23, and the bell member 13 can then in turn be fixed to the leg member 22, for example by means of a screw 24.

However, as an alternative or in combination, and as shown diagrammatically in broken lines in FIG. 1, the bell member 13 can be fixed to the casing 12 on a top plate 25 of the casing, which is parallel to the intermediate plate 18 and therefore to the closure plate 14 and which for this purpose comprises, ready for use, a plurality of apertures 26 arranged for fixing therein as desired the end of a tongue member 27, to the other end of which the bell member 13 can be fixed.

The casing 10 has a passage 30 which, as will be described hereinafter, is arranged to participate in holding and guiding the control mechanism 12. The passage 30 is provided in a part 29 of the lateral wall of the casing, which is relatively close to the skirt of the bell member 13 and which is substantially planar in form and which is set back relative to the remainder of the lateral wall, perpendicularly to the plates 18 and 25 and thus perpendicularly to the closure plate 14.

Figure 2:
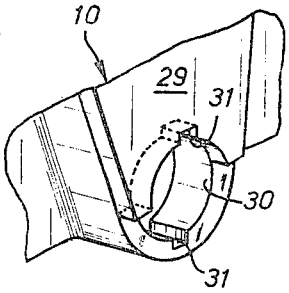
FIGS. 2, 3 and 4 are perspective views on a larger scale of parts of the casing of the device, as viewed along arrows II, III and IV respectively in FIG. 1.

As best shown in FIG. 2, the passage 30 is cylindrical overall and at diametrally opposed positions it has two grooves 31, parallel to its axis.

On the part of its lateral wall opposite to the abovementioned planar portion 29, the casing 10 has a blind housing 34 which has a semicylindrical end and which, as will be described hereinafter, is arranged to provide for holding and guiding the control mechanism 12.

Figure 3:
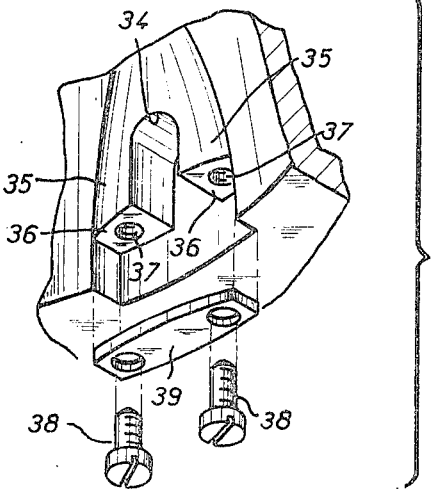

As best seen in FIG. 3, the housing 34 has disposed on each side of it two upstanding portions 35 which terminate in co-planar shoulders 36 at which passages 37 open. Thus, for reasons which will be apparent hereinafter, it is possible to secure thereto a fixing plate 39, by means of screws 38.

Internally, the casing 10 has bosses 40 from place to place. The closure plate 14 can be secured to such bosses by means of screws 41 and moreover can be fitted at its periphery against a support rib 42 which is also provided for this purpose in the casing 10.

Close to the peripheral skirt which forms the free edge of the casing 10, the casing 10 also has a passage 43 for a screw 44 permitting the casing 10 to be fastened to a first tongue portion 45 which for this purpose is carried by the plate 15; preferably, and in order to provide indexing of the casing 10 relative to the plate 15, in order thereby to ensure correct mounting of the casing on the plate 15, the passage 43 of the casing is formed in a part thereof which is complementary to the tongue portion 45 of the plate 15 and which for example projects radially.

Figure 4:
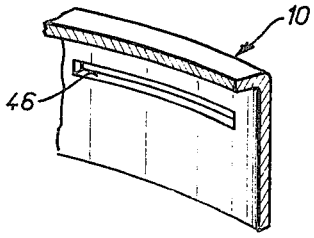

Opposite to the passage 43, the casing 10, conjointly, in its peripheral skirt, has a slot 46 (FIGS. 1 and 4) by which it can be engaged on a second tongue portion 47 provided for this purpose by the mounting plate 15.

In the embodiment illustrated, the tongue portions 45 and 47 of the mounting plate 15 extend in opposite directions relative to each other and are carried by a cylindrical wall 48 which with a bottom member 49 defines a volume 50 which is employed for housing connecting members 52.

In the embodiment illustrated, such connecting members are female connecting members and are in the form of rails which extend parallel to the alignment formed by the passage 30 and the housing 34 of the casing 10 and therefore, as will become apparent hereinafter, parallel to the axis of the control mechanism 12 which is disposed in the casing.

The connection members 52, which are two in number, are each respectively electrically connected to terminals 53 to which electrical supply leads (not shown in the drawings) can be connected.

In the embodiment illustrated, the plate 15 is fixed with respect to a box 55 arranged to be embedded in the wall 17, the box 55 being provided so that the electrical supply leads in question can be brought out at that position.

However, this arrangement is not absolutely necessary.

In addition, the means for securing the plate 15 to the wall 17 can be any means whatever.

In per se known manner, the control mechanism 12 comprises a control solenoid 56 wound spirally on a spool 57 which itself comprises a hollow axial barrel 58 and, at the axial ends of the barrel, two transverse end flanges or plates 59 and 60.

The end plate 59 which is closest to the skirt of the resonantor 13 has a tubular extension 61 projecting in its axial region, in continuity with the associated axial barrel 58. The periphery of the tubular extension 61 is complementary to the passage 30 provided in the corresponding planar portion 29 of the wall of the casing 10. For the purposes of co-operation with the grooves 31 of the passage, the tubular extension 61 carried by the end plate 59 of the spool 57 has two ribs 62 at diametrally opposed positions, which extend radially in opposite directions relative to each other and which extend longitudinally parallel to the axis of the assembly. These ribs 62 prevent any rotation of the spool 57 relative to the casing 10 and provide for indexing of the spool 57 relative to the casing 10, for correct assembly of the spool with respect to the casing. In this connection, the ribs 62 can be replaced by complementary engagement means which are provided for that purpose between the spool and the casing.

The end plate 59 of the spool 57 also carry two connecting members 63 which, in the embodiment illustrated, are male connecting members arranged to co-operate with the female connecting members 52 provided for that purpose in the housing 50 associated with the mounting plate 15.

In the embodiment illustrated, each of the male connecting members 63 is in the form of a blade member which is bent into the form of a right angle and whose bent end 64 has on the one hand a resiliently deformable retaining tongue portion 65 produced by forming an opening 66, and on the other hand a fixing means such as a notch 67 for example, as shown, for connecting thereto an end of the control solenoid 56.

Conjointly, for each male connecting member 63, the end plate 59 of the spool 57 has a projecting block 69 having a passage for engaging the bent end 64 of such a connection member.

As will be readily understood, when the bent end 64 of a connection member 63 is engaged into such a passage, the retaining tongue portion 65 on the bent end is resiliently deflected; when such engagement is completed, the retaining tongue portion 65 returns resiliently to its original configuration in order to co-operate with the corresponding face of the block 69 in which the passage in question is formed, to provide a retaining action. It is then sufficient to connect the end in question to the control solenoid 56.

Preferably, and as illustrated, the end plate 59 of the spool 57 has slots 70 passing through its thickness, to provide passages for the ends of the control solenoid 56. The slots 70 extend over a part of the periphery of the end plate 59, at diametrally opposite positions, and open in line with the blocks 69.

In the embodiment illustrated, the end plate 60 of the spool 57, which is most remote from the skirt of the bell member 13, also has a tubular portion 72 extending axially in its axial region. For reasons which will become apparent hereinafter, the tubular extension 72 which is in alignment with the axial barrel 58 of the spool is closed at its end by an apertured end member 73.

The tubular extensions 61 and 72 form, together with the axial barrel 58, a housing for guiding a striker member 74 forming the movable core of the solenoid 12.

The striker member 74 which is essentially of magnetic material is adapted to co-operate with the resonator 13 and for this purpose an end member 75 of non-magnetic material forming a hammer is secured axially to the axial end which corresponds to the tubular extension 61.

At its other end, the striker member 74 has a blind axial housing 76, against the end of which a spring 77 bears. The spring 77 is thus disposed between the striker member 74 and the end member 73 of the tubular extension 72.

In a characteristic arrangement of the invention, associated with the control solenoid 56 are at least two permanent magnets 78 which are in opposition to each other and which are uniformly distributed in a circular manner around the axis of the solenoid 56 at one of the axial ends thereof, the permanent magnets all having their pole line substantially perpendicular to the axis of the solenoid 56, with a pole of like polarity directed towards said axis.

In the embodiment illustrated in FIGS. 1 to 6, the permanent magnets 78 are two in number and they are arranged at diametrally opposed positions on respective sides of the tubular extension 72 carried by the end plate 60 of the spool 57, between the end plate 60 and a cap or casing 80 secured thereto.

For example, as shown the north pole N of each of the magnets 78 is directed radially towards the axis of the solenoid 56, while the south pole S of such a magnet is directed radially away from such axis.

Figure 6:
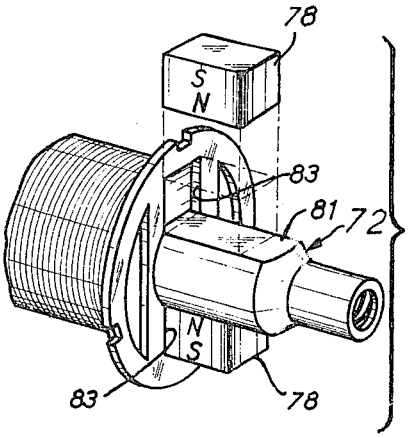
FIG. 6 is another perspective view of part of this mechanism, taken along VI in FIG. 5.
Figure 7:
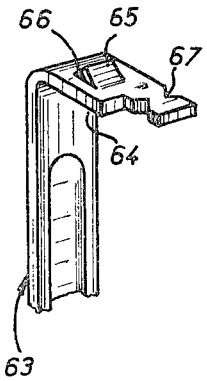
FIG. 7 is a perspective view on a different scale of part of a connection member carried by the control mechanism.
Figure 5:
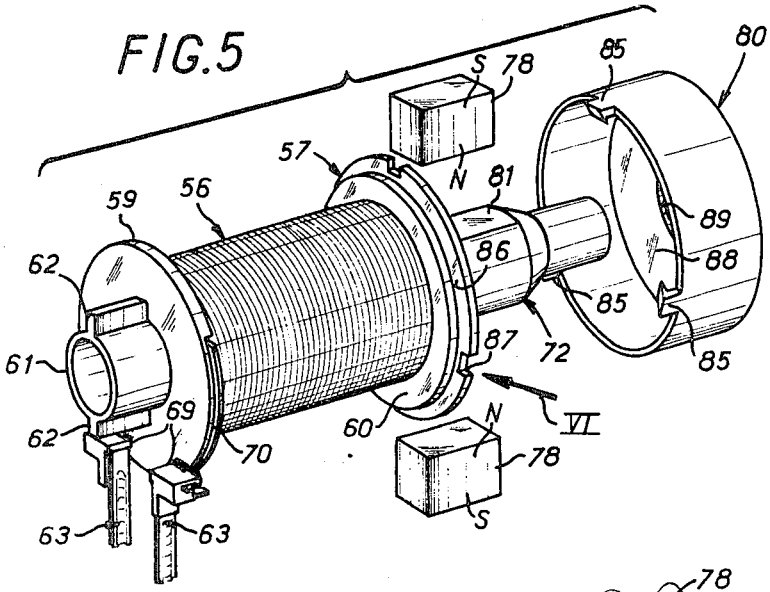
FIG. 5 is a perspective exploded view of the control mechanism enclosed by the casing.

In the embodiment illustrated, each of the magnets 78 thus bears by way of its north pole against a flat portion 81 provided for this purpose on the outside surface of the tubular extension 72 carried by the end plate 60 of the coil 57. At one of its end faces, as best shown in FIG. 6, each magnet 78 is also partially received in a housing 83 provided for this purpose in the surface of the end plate 60.

In the embodiment illustrated, the cap or casing 80, in the internal volume of which are housed the magnets 78, is secured by clipping onto the end plate 60 of the spool 57.

For example, as shown, the cap 80 has a plurality of resiliently deformable clipping hooks 85 which project axially at its free edge. There are three such hooks in the embodiment illustrated and each is adapted to co-operate with a retaining shoulder 86 provided for this purpose at the periphery of the end plate 60 of the spool 57, on the face of the end plate 60 which is towards the opposite end plate 59.

Preferably, and as illustrated, to provide for indexing of the cap or casing 80 relative the spool 57, the end face of the end plate 60 of the spool has notches 87 provided for receiving the clipping hooks 85 of the cap or casing 80.

Finally, in the embodiment shown in FIGS. 1 to 6, the tubular extension 72 carried by the end plate 60 of the spool 57 passes axially through the end 88 of the cap or casing 80, by way of a passage 89 provided for this purpose, and projects substantially beyond the end 88.

Thus, the assembly formed by the spool 57 and the cap or casing 80 which is connected to the end plate 60 of the spool 57 comprises tubular extensions 61 and 72 at its axial ends. It is by means of such tubular extensions that said assembly, which in itself forms the control mechanism 12, is connected to the casing 10.

In practice, the tubular extension 61 is engaged into the passage 30 in the casing, at a slight angle, and then, by a pivotal movement of the control mechanism 12, the tubular extension 72 is in turn engaged in the housing 34.

The fixing plate 39 is then secured to the upstanding portions 35 on respective sides of the housing 34, thus connecting the control mechanism 12 to the casing 10.

As will be readily understood, it is possible for the mechanism 12 to be axially displaced relative to the casing 10, for adjustment of the position of the control mechanism relative to the bell member which is secured to the casing 10.

As will also be readily understood, the casing 10 which is moreover closed at its base by the closure plate 14, the plate 14 having apertures 91 for passing the male connection members 63 carried by the spool 57, is engaged by means of slot 46 onto the tongue portion 47 carried by the mounting plate 15, at a slight angle of inclination, and then pivoted until it can be fixed to the tongue portion 45 on the mounting plate 15 opposite to the above-mentioned tongue portion.

During this pivotal movement, the male connection members 63 come into engagement in the female connection members 52 provided for this purpose in the internal housing 50 associated with the mounting plate 15, and, as will be understood, because the female connection members are in the form of rails, this engagement is effected in a suitable manner irrespective of the axial position of the control mechanism 12 relative to the casing 10. Thus, forming the female connection members 50 as rails provides for axial adjustment of the mechanism 12 relative to the casing, as mentioned above, without concomitant adjustment of the male connection members 63 being necessary, as such male connection members are fixed to the mechanism 12.

In an alternative embodiment (not shown), adjustment of the mechanism 12 can be effected from the outside of the casing 10, even after the casing has been mounted on the plate 15.

As will be noted, the permanent magnets 78 form axially between them a passage 100 whose boundary in the embodiment illustrated in FIGS. 1 to 7 is provided in material form by the cylindrical wall of the tubular extension 72 carried by the end plate 60 of the spool 57, and in which the striker member 74 formed by the movable core of the solenoid 56 can at least partially engage, against the action of the associated spring 77, in the embodiment illustrated.

Figure 8A:
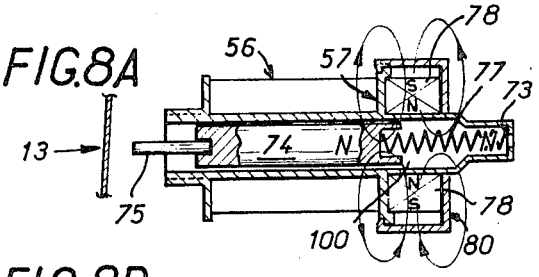
FIGS. 8A, 8B and 8C are partial views similar to that of FIG. 1, illustrating operation of the mechanism of the acoustic warning device according to the invention.

Moreover, as will be seen from the flux lines shown in FIG. 8A, with the permanent magnets 78 composing their effects within the passage 100, operation is as if such permanent magnets together had an equivalent magnet in the passage 100, namely an immaterial imaginary single magnet having two poles of like polarity on the axis of the passage.

In the embodiment illustrated, the magnets 78 have their north pole towards the axis of the solenoid 56 so that the resulting imaginary magnet has, along such axis, two north poles N, as shown.

Hence, operation of the bell according to the invention is as follows:

In the rest condition, that is to say, when the control solenoid 56 is not supplied with voltage, the movable core 74 of the solenoid which forms the striker member associated with the resonator 13 is subjected to an axial attraction force by the imaginary magnet equivalent to the permanent magnets 78, and such attraction force moves the striker member away from the resonator 13 against the action of the spring 77.

The permanent magnets 78 and the spring 77 therefore combine to provide a joint definition of a rest position for the movable core 74 in which the movable core 74 is spaced from the resonator 13 in the embodiment illustrated.

Figure 8B:
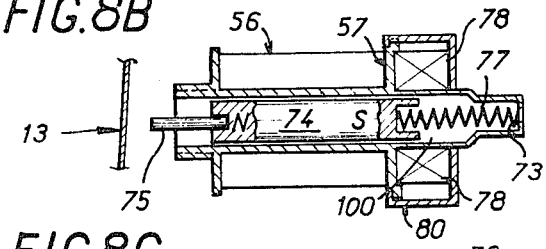

It will now be supposed that, when the control solenoid is supplied with alternating current voltage, the first half-wave of the current is such that a south pole S appears at the axial end of the movable core 74 which is closest to the imaginary magnet equivalent to the permanent magnets 78, as shown in FIG. 8B.

An increased attraction force is thus developed between the movable core 74 and the imaginary magnet as, as mentioned above, the imaginary magnet has a north pole facing the movable core 74, and the movable core 74 thus moves axially further away from the resonator 13, against the force of the spring 77 which is put under compression.

However, the movement of the movable core 74 causes the movable core 74 to enter into the passage 100 provided between the permanent magnets 78, and this substantially modifies the flux lines of the permanent magnets and thus the flux lines of the imaginary magnet which is equivalent thereto, in such a way that the attraction force developed by the equivalent imaginary magnet on the movable core 74 then remains substantially linear, like the counteracting repulsion force which is applied jointly to the movable core 74 by the spring 77 which is associated therewith, as the spring is compressed.

Figure 8C:
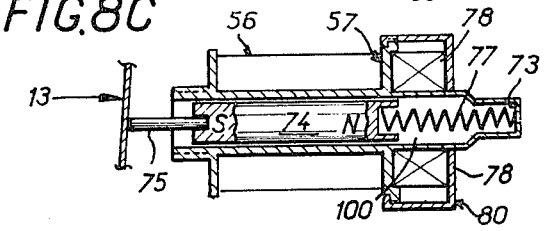

In the following half-wave of the supply voltage for the control solenoid 56, a north pole N is developed on the movable core 74 at the axial end thereof which is closest to the permanent magnets 78, as shown in FIG. 8C, so that the movable core 74 is henceforth the object, on the part of the imaginary magnet equivalent to the permanent magnets 78, of a repulsion force which is added to that developed conjointly in the same direction by the spring 77 and which causes the movable core 74 to strike against the resonator 13, by way of the end member 75 of the movable core 74.

The above-described operations are then cyclically repeated as long as voltage is supplied to the control solenoid 56.

Figure 10:
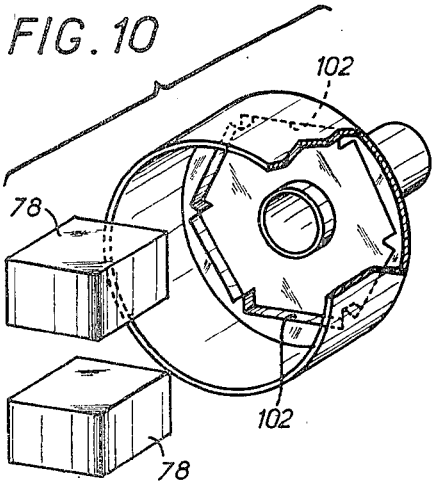
FIG. 10 is a perspective view of part of the modified embodiment.
Figure 9:
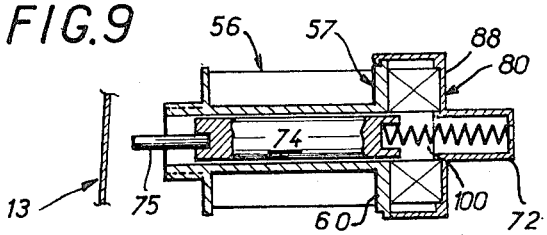
FIG. 9 is a view similar to that of FIG. 8A, showing an alternative embodiment.

In the alternative embodiment shown in FIGS. 9 and 10, the tubular extension 72 is transferred from the end plate 60 of the spool 57 to the end 88 of the cap or casing 80, so that the passage 100 formed axially by the permanent magnets 78 has no material boundary on at least the part of its length which is immediately adjacent to the end plate 60 of the spool 57.

Accordingly, the gap at this position between the permanent magnets 78 and the movable core 74 can be reduced to a minimum value which is just sufficient for sliding movement of the movable core 74 in the passage 100, without danger of jamming.

As is best shown in FIG. 10, each of the permanent magnets 78 in this embodiment is at least partially received in a housing 102 provided for this purpose at the surface of the end 88 of the cap or casing 80. Obviously, and this also applies as regards the embodiment described with reference to FIGS. 1 to 7, each permanent magnet 78 can moreover be suitably secured, for example by sticking, to the end 88 of the cap or casing 80 and/or to the end plate 60 of the spool 57.

Figure 11:
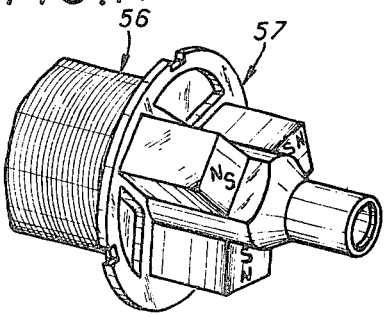
FIG. 11 is a partial perspective view similar to that of FIG. 6, of another modified embodiment.

The alternative embodiment diagrammatically shown in FIG. 11 has three permanent magnets 78.

In this embodiment, as for the embodiment described with reference to FIGS. 1 to 7, the magnets are partially housed in housings provided for this purpose in the end plate 60 of the spool 57, but obviously they could be partially encased in housings provided for this purpose in the cap or casing associated with the end plate 60, or these two arrangements can be combined together.

In addition, in the embodiment illustrated in FIG. 11, the permanent magnets 78 all have their south pole directed towards the axis of the solenoid 56. This arrangement can moreover also be adopted for one or other of the embodiments described above.

The assembly and mode of operation of these various embodiments are similar to those described above with reference to FIGS. 1 to 8.

Obviously, the invention is not limited to these various embodiments but includes any other modified embodiment and/or combination of their various components.

In particular, any number of permanent magnets can be used, and similarly as regards the means used for ensuring that they are suitably positioned around the axis of the control solenoid with which they are associated.

In practice, in the limit case the number of permanent magnets used could be infinite, in which case the permanent magnets together form a torus around the axis of the control solenoid, with a continuous north or south pole along its internal periphery and a continuous south or north pole along its outside periphery, each having an infinitesimal circumferential development within such a torus.

For example, in this case the permanent magnets can be formed within a flexible support arranged to be looped into an annular form around the axis of the control solenoid.

In addition, instead of being arranged at the side of the end plate of the solenoid coil which is remote from the resonator, the permanent magnets could be disposed on the side of the spool end plate which is closest to the resonator.

This could also apply to the spring 77 associated with the movable core 74 of the solenoid 56.

In addition, two springs can be provided in association or in opposition, one spring at one of the axial ends of the control solenoid and the other spring at the other of the axial ends of the control solenoid, in which case the movable core of the solenoid is then so-to-speak resiliently suspended between the springs.

In an alternative embodiment (not shown), the closure plate 14 associated with the casing 10 can be resiliently secured thereto at two points and for this purpose has two tongue portions, one which is placed upon the tongue portion 47 of the mounting plate 15 and is engaged, like the tongue portion 47, into the slot 46 in the casing, and the other which is placed upon the tongue portion 45 of the mounting plate and thereby renders the associated screw 44 impossible to lose.

Also, instead of being clipped onto the corresponding end plate of the spool 57, the cap or casing 80 can be rigidly connected to the end plate by crimping or riveting, particularly in the embodiment illustrated in FIGS. 9 and 10.

The casing 10 can obviously be made in a single piece, for example by moulding or synthetic material.

Finally, the bell according to the invention can be supplied with continuous current, when a chopper is used; the mode of operation of the mechanism 12 then remains generally as described above; preferably, the chopper is controllable from the outside of the casing, to provide for adjustment of the operating characteristics of the assembly.

In every case, as has been noted, there is no magnetic circuit associated with the control solenoid, and the flux developed by the solenoid and the flux developed by the permanent magnet or magnets are therefore not combined by magnetic coupling by way of such a magnetic circuit.

It is within the movable core itself that the combination between the two fluxes occurs, and the result is, as stated above, that it is as if the solenoid-permanent magnets assembly formed two magnets, one fixed and the other variable in strength and direction, the magnets being secured together by the body of the spool forming the solenoid, and the corresponding reaction then occurring on the only movable element, namely the movable core of the solenoid.

I claim:

1. An acoustic warning device comprising, a striker member forming a movable core of a control solenoid and arranged to strike resonator means in response to energization of said solenoid, permanent magnet means adapted to define in cooperation with retaining means a rest position for the striker member, said permanent magnet means being in coaxial alignment with the solenoid and disposed beyond one end of said solenoid, said permanent magnet means having radial pole lines with the same polar orientation, one end of said movable core proximate to said permanent magnet means extending only partly into the axial zone corresponding to the axial extent of said permanent magnet means.

2. An acoustic warning device comprising a resonator, a striker member forming a movable core of a control solenoid and arranged to strike the resonator in response to energization of said solenoid, permanent magnet means adapted to define in cooperation with retaining means a rest position for the striker member, said permanent magnet means being disposed beyond one end of said solenoid with their axes in alignment, said permanent magnet means having radial pole lines with the same polar orientation, said permanent magnet means in cooperation with said retaining means limiting axial outermost displacements of an end of said movable core proximate to said permanent magnet means within the axial zone corresponding to the axial extent of said permanent magnet means.

3. An acoustic warning device comprising a resonator, a striker member forming a movable core of a control solenoid and arranged to strike the resonator in response to energization of said solenoid, permanent magnet means adapted to define in cooperation with retaining means a rest position for the striker member, said permanent magnet means being disposed beyond an end of said solenoid with the axes of said permanent magnet means and said solenoid substantially in alignment, said permanent magnet means having radial pole lines with the same polar orientation, support structure for said solenoid and said permanent magnet means in their immediate proximity being substantially entirely of nonferromagnetic material.

4. An acoustic warning device comprising resonator means, a striker member forming a movable core of a control solenoid and arranged to strike the resonator means in response to energization of said solenoid, permanent magnet means adapted to define in cooperation with retaining means a rest position for the striker member, said permanent magnet means being disposed beyond one end of said solenoid with their axes generally in alignment, said permanent magnet means having radial pole lines all with the same polar orientation, the core member defining the main path of magnet flux through the interior of said solenoid.

5. A device according to claim 4, wherein said permanent magnet means comprises a plurality of regularly spaced permanent magnets around the continuation of the axis of said solenoid through said permanent magnet means.

6. A device according to claim 5, wherein said permanent magnet means comprises a single annular permanent magnet with its axis coinciding with the continuation of the axis of said solenoid.

7. A device according to claim 4, wherein a passage for said core member is defined inside said permanent magnet means in continuation with the interior of said solenoid.

8. A device according to claim 4, wherein said solenoid having a spool including a hollow axial barrel on which it is wound and a transverse end plate, further comprising a cap cooperable with said transverse end plate for housing said permanent magnet means.

9. A device according to claim 8, wherein said permanent magnet means is partly engaged in a recess in a surface of said transverse end plate facing away from said solenoid.

10. A device according to claim 8, wherein said permanent magnet means is partly engaged in a recess provided in an end surface of said cap.

11. A device according to claim 8, wherein said cap has means for clipping it onto said transverse end plate.

12. A device according to claim 11, wherein said clipping means comprises at least two axially extending, resiliently deformable clipping hooks cooperable with retaining shoulders disposed at the periphery of said transverse end plate.

13. A device according to claim 8, further comprising means for rigidly connecting said cap to said transverse end plate.

14. A device according to claim 8, wherein said hollow barrel has an axially projecting tubular extension around which said permanent magnet means is disposed.

15. A device according to claim 14, wherein said tubular extension passes through said cap.

16. A device according to claim 15, wherein said retaining means comprises a spring member bearing at one end against said core member and at the other end against a closed end of said tubular extension.

17. A device according to claim 7, wherein said solenoid has a spool including a hollow axial barrel on which it is wound and a transverse end plate, said end plate carrying two electrical connecting members connected to respective electrical ends of the solenoid.

18. A device according to claim 7, further comprising blocks on said transverse end plate for accommodating said connecting members, said connecting members having resilient tongues for retaining them in their respective blocks.

19. A device according to claim 8, further comprising a casing for said solenoid, means for fixing said resonator means to said casing, wherein said spool and cap form an assembly having axial tubular extensions in engagement with complementary passages in said casing.

20. A device according to claim 19, further comprising means on one of said tubular extensions for preventing rotation of said assembly relative to said casing.

21. A device according to claim 20, wherein said retaining means is a spring member bearing at one end against said core member and at its other end against an apertured end wall of a corresponding tubular extension.

22. A device according to claim 19, further comprising a mounting plate to which said casing is adapted to be secured, said mounting plate carrying electrical connecting members cooperable with electrical connecting members on a transverse end plate at the other end of said spool, said electrical connecting members carried on said mounting plate formed as bars extending parallel to the axis of the solenoid to enable axial adjustment of solenoid without having to adjust the position of the connecting members.

23. A device according to claim 22, wherein said spool and said cap form an assembly which is axially adjustable in said casing.

24. A device according to claim 19, wherein said casing has plural knock-out sections for providing passages to accommodate different sized resonator means on said casing.

25. An acoustic warning device comprising a striker member forming a movable core member of a control solenoid and arranged to strike resonator means in response to energization of said solenoid, permanent magnet means adapted to define in conjunction with retaining means a rest position for said striker member, said permanent magnet means being disposed beyond one end of said solenoid with their axes generally in alignment, said permanent magnet means being radially polarized, a passageway extending through said solenoid and said permanent magnet means and defined by a nonferromagnetic tubular member extending through at least said solenoid means, whereby said core member is reciprocated by the repulsion and attraction effect produced by the permanent magnet means on the end of said core member which is of alternating polarity proximate to said permanent magnet means.

26. An acoustic warning device comprising a control solenoid having a movable core disposed along its axis and defining a striker member, arranged to strike resonator means disposed at one end of said solenoid, in response to energization of said solenoid, permanent magnet means disposed at the other of said solenoid, spring means tending to urge said core member towards said resonator means, said permanent magnet means defining with said spring means a position of said other end of said core member proximate to said permanent magnet means substantially within the axial confines thereof, said permanent magnet means repulsing and attracting said other end of said core member due to the alternating polarity thereof so that said striker member alternately strikes said resonator means.

* * * * *

UNITED STATES PATENT AND TRADEMARK OFFICE

CERTIFICATE OF CORRECTION

PATENT NO. : 4,097,862

DATED : June 27, 1978

INVENTOR(S) : Yves Brionne

It is certified that error appears in the above-identified patent and that said Letters Patent are hereby corrected as shown below:

Claim 6, line 1, "5" should read -- 4 --.

Claim 8, line 1, cancel "wherein".

Claim 18, line 1, "7" should read -- 17 --.

Claim 26, line 6, after "other" insert -- end --.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*